United States Patent [19]

Gerretz

[11] 4,064,730

[45] Dec. 27, 1977

[54] TUBE EXPANDER

[75] Inventor: Richard Gerretz, Viersen, Germany

[73] Assignee: Mannesmann Aktiengesellschaft, Dusseldorf, Germany

[21] Appl. No.: 778,227

[22] Filed: Mar. 16, 1977

[30] Foreign Application Priority Data

Mar. 18, 1976 Germany ..... 2611702

[51] Int. Cl.[2] ..... B21D 41/02

[52] U.S. Cl. ..... 72/393; 308/3 R

[58] Field of Search ..... 308/3 R, 3 A; 72/393; 269/48.1; 279/2 R

[56] References Cited

U.S. PATENT DOCUMENTS

| | | | |
|---|---|---|---|
| 1,671,697 | 5/1928 | Burke | 72/393 |
| 1,719,720 | 7/1929 | Olsen | 72/393 |
| 2,943,667 | 7/1960 | Ewing et al. | 72/393 |

FOREIGN PATENT DOCUMENTS

| | | | |
|---|---|---|---|
| 15,011 | 2/1904 | Austria | 269/48.1 |

*Primary Examiner*—Lowell A. Larson

*Attorney, Agent, or Firm*—Ralf H. Siegemund

[57] ABSTRACT

The expander is constructed from an irregular, truncated polyhedral pyramid in which surfaces bounded by parallel edges alternate with surfaces of trapezoidal contour. The latter have T-shaped longitudinal grooves each receiving respectively the T-shaped foot portion of double T-contoured guide elements and being secured to the groove from axial ends of the pyramid.

2 Claims, 2 Drawing Figures

TUBE EXPANDER

BACKGROUND OF THE INVENTION

The present invention relates to mechanical tube expanders of the type in which a trunkated polyhedral pyramid is provided as basic support, and tube expanding segments are disposed for sliding on the surfaces of the pyramid.

Tube expanders of the type referred to above are known in different varieties. One type, for example, is shown in U.S. Pat. No. 3,798,955. Another type is shown in German Pat. No. 2,258,360. The latter expander has T-shaped guide elements for positioning and guiding the expander segments. The segments have rectangular glide portions respectively running in undercut rails of the guide elements. In this known construction, the guide elements are disposed on the corner edges of the polyhedral pyramid and fastened thereto by bolts. It was found that these bolts may readily loosen and may project into the gap between two segments which narrows when the segments are shifted towards the narrow end of the pyramid. Thus, such bolts may be wedged into that gap and break the expander.

DESCRIPTION OF THE INVENTION

It is an object of the present invention to improve the arrangement of a polyhedral pyramid and of guide elements for a tube expander with expander sections, so that the fastening of the guide elements does not pose the problem outlined above, and the operational safety of the expander, as well as its maintenance, is improved accordingly.

In accordance with the preferred embodiment of the invention, it is suggested to construct the polyhedral pyramid so that surfaces on which expander segments slide, alternate with surfaces having a central, T-shaped groove. The guide elements are constructed as double T-elements of which one T-portion is inserted in one of the grooves, while the other T-portion serves as a lateral guide for the two respective adjacent expander segments. The guide elements have been slipped into the grooves as stated and are fastened thereto. Preferably, the grooves end ahead of the narrow end of the pyramid, and the guide elements abut accordingly. The other ends of the guide elements are bolted in some fashion to the wide end of the pyramid. The bolts extend in the direction of the axis of the pyramid and, therefore, cannot possibly reach into any working gap of the expander.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
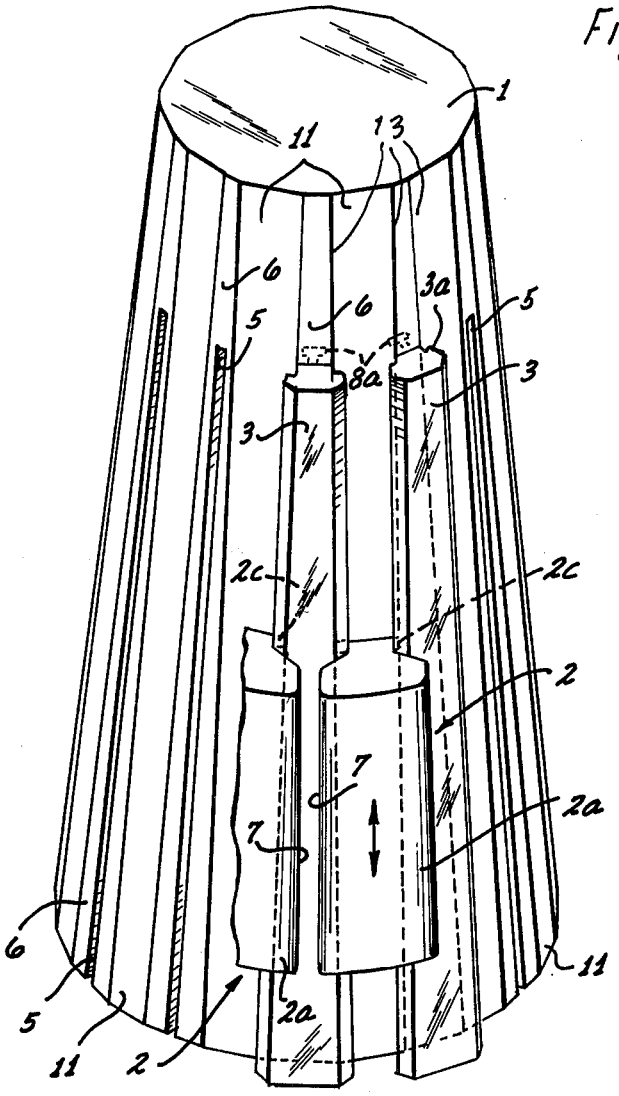
FIG. 1 is an isometric side view of an expander in accordance with the preferred embodiment of the present invention.

Proceeding now to the detailed description of the drawings, the tube expander illustrated therein is comprised of a body 1 which is, basically, a trunkated, polyhedral pyramid. The particular pyramid is of a particular irregular contour; the irregularity can be explained best by assuming initially a regular polyhedral pyramid. Such a regular pyramid were present if all the side faces were similar and continued to form edges or edge lines 4 and converge towards a common, hypothetical apex.

In order to generate the particular pyramid, these edges 4 have been cut to form sides 6 leaving rectangular surfaces 11. Therefore, these main faces, facets or surfaces 11 of the pyramid are of rectangular contour and alternate with faces, facets or surfaces 6, whereby each surface 11 is bounded with respect to the two surfaces 6 on both sides of parallel edges 13. Accordingly, each of the surfaces 6 is either of triangular or trapezoidal configuration, depending on where one places the trunkated end. For practical reasons, they are trapezoidal.

The true edges 13 of this irregular pyramid, being the edges between alternating surfaces 11 and facets 6, do not converge towards a common apex, but, as stated, the two edges of each surface 11 run parallel to each other. On the other hand, the width *a* from edge 13 to edge 13 or a surface 6 will decline in direction towards the apex or narrow end of the pyramid. Accordingly, the pyramid is deemed an irregular one on account of the fact that none of the edges extend towards a common apex but separate alternating rectangular and trapezoidal faces.

Figure 2:
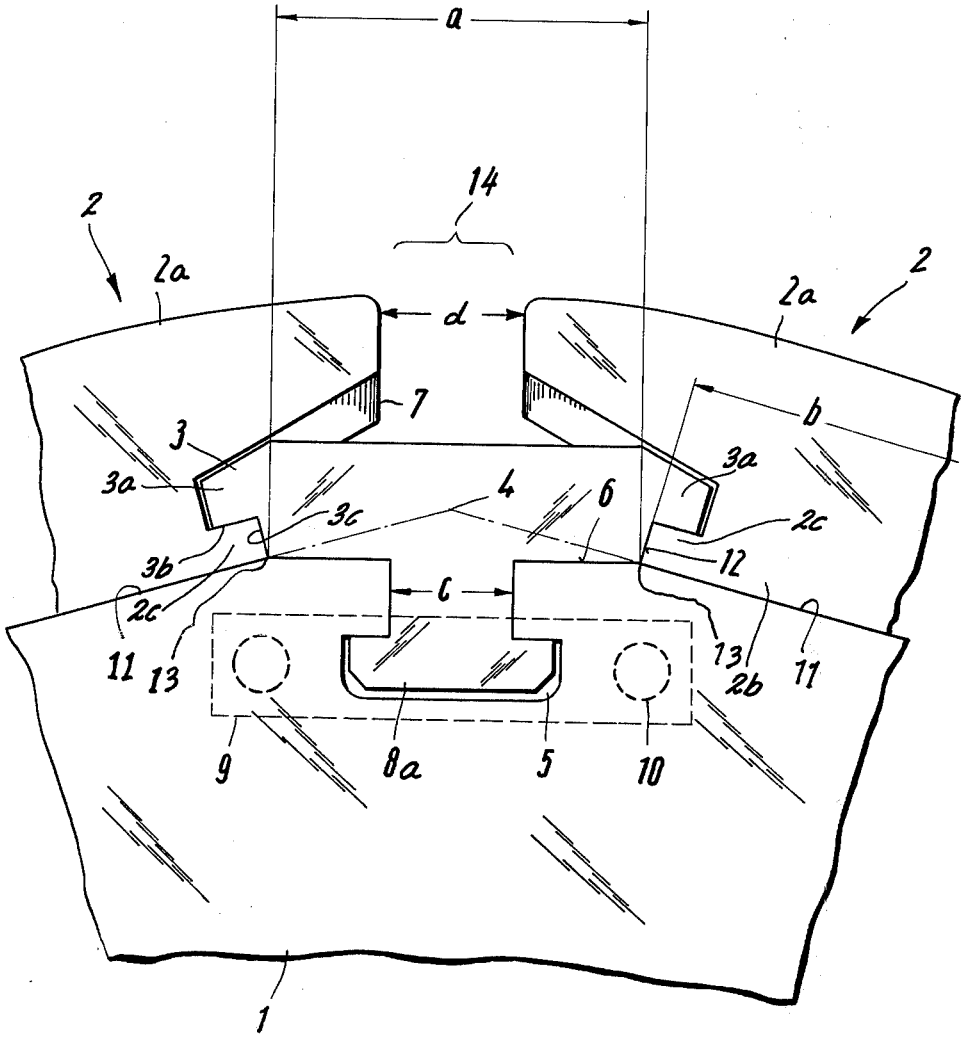
FIG. 2 is an enlarged front end view of the tube expander shown in FIG. 1.

Reference numeral 2 refers to tube expanding segments having a cross-section which can be taken from FIG. 2. Each segment 2 has working portion 2*a* which is of tapered contour, i.e. trapezoidal in top view. The tapering is so chosen that the gap 14 between adjacent side surfaces 7 of neighboring segments has constant width *d* from the length of the expander. In other words, the sides 7 of adjacent segments extend parallel to each other and to the imaginary edge line 4 in between, but not to the respective associated edges 13 bounding the face 6 above which the sides 7 under consideration are located. This is represented by the view in FIG. 2 showing these surfaces 7 in true representaiton, one sees along them as they extend parallel to the direction normal to the plane of the drawing of FIG. 2.

Each segment 2 has a foot portion 2*b* and these foot portions have a width *b* which is constant, i.e., the foot portions seen from the bottom are rectangles. These foot portions slide on the surfaces 11 of pyramid 1, and they extend from one edge 13 to the other edge 13 as bounding the same slide surface 11.

As shown, the pyramid surfaces 6 have slots or grooves such as groove 5, which are of T-configuration. Thus, each groove 5 has a widened portion and a stem portion of width *c* in the drawing. The width *c* as well as the width of the widened portion of the groove could decline in the direction towards the apex or be constant. In top view, therefore, this groove would appear as a very steep V, a trapez or as rectangular slot. For reasons of ease of machining, the groove or slot 5 has constant dimensions over the length of its extension as shown in the drawing. Particularly, width *c* is preferably constant. In either case, each groove or slot ends ahead of the trunkation and narrow end of the pyramid, and is, therefor, a blind duct. The slots or grooves 5 must end at a point where the distance of edges 13 is still well above width *c*. The grooves 5, however, do extend all the way to the wide end of the pyramid.

The transverse or crossbar portion of the groove 5 receives the crossbar or foot portion 8 of a guide element 3 having double T cross-section, of which the stem is located in the stem portion of groove 5. The bottom of the upper crossbar portion of guide element 3 extends from edge 13 to edge 13 of and resting firmly on the facet 6 bounded by these edges.

The top or upper crossbar portion of each element 3 is bounded by overhung edges, bars, ridges or rails 3*a*, whose lower surface portion 3*b* in each instance, together with the side surface 3*c* of the upper crossbar of guide element 3, and further together with portions of surfaces 11 near edges 13 define rail grooves which receive the rail portion 2*c* of the foot 2*b* of a segment 2. In other words, each element 3 has two contoured portions 3*b* in form oblique overhung ridges, engaging from above one foot each of two expander elements 2. These rail grooves converge towards the pyramid's apex or its narrow end, they do not, however, meet. On the other hand, the rail portions of ajacent guide elements for the same expander segment 2 extend parallel to each other so that the parallel rails of the foot portion of that segment can readily slide therein.

Since groove 5 ends ahead of the trunkation end of the pyramid, the respective element 3 therein sits firmly in that groove by its foot 8. The element 3 and particularly its foot 8 is held on the other wide end of the pyramid by a cover plate 9 shown only in dotted lines. Reference numeral 10 denotes bores in body 1 to the pyramid body. Additional adjusting bolts may be provided for positioning the elements 3. In lieu of individual fastening and holding plates 9, one could use a simple flange ring or the like to fasten all of the elements 3 in their respective positions.

All of the bores 10 and, therefore, the bolts fastening the cover plates or flange ring to the body 1, and any adjusting screws or bolts extend parallel to each other and to the pyramid's axis. They do not experience any work forces because during tube expanding hardly any axial force acts on the elements 3. The bolts are secured or locked against loosening and even if some of them should be loosened, it will not reach nor drop into the gap 14.

During tube expanding, elements or segments 2 slide on the respective surfaces 11, whereby the gap 14 between any two of them varies uniformly in width; when the segments 2 are in their forwardmost position, that gap is reduced to zero. Thus, when the segments 2 have been advanced to the point that the edges 7 of adjacent segments abut, the segments cannot be moved further. This then is for all practical purposes also the end of guide element 3, whose width has been reduced from *a* (in FIG. 2) to *a–d*. This particular example is only one possibility of practicing the invention. It may well be advisable to have two such guide elements of the type shown as 3 arranged along the same set of edges 13 whereby a smaller (narrower) one is disposed near the narrow end of the pyramid, with a narrower groove 5 and being held by the wider guide element which, in turn, is secured by a bar 9 or otherwise as outlined above.

The particular expander has additional advantages. For example, the profils of the guide elements 3 is of such configuration that it is easier to be made than the guide elements in the above-identified German patent. Due to obliqueness of the two support surfaces in the latter patent, the workpiece is difficult to clamp for working. Except for a bevel, all surfaces of the foot 8 are at right angles and extend parallelly in pairs. The same is true with regard to the upper portion of guide element 3, except for the oblique disposition of the rail portion 3*a* whose surfaces, particularly 3*b* and 3*c*, must have narrow tolerances, but they are rather easy to work on to their particular orientation. The guide elements 3 may have parallel surfaces which feature is quite advantageous in connection with clamping and measuring on the machine tool.

The invention is not limited to the embodiments described above but all changes and modifications thereof not constituting departures from the spirit and scope of the invention are intended to be included.

I claim:

1. A mechanical expander for tubes comprising:

a trunkated polyhedral pyramid having a wide end and a narrow end, further having first glide surfaces being inclined with respect to the axis and having at least in parts rectangular configuration, second surfaces alternating with said first surfaces and being also inclined and having trapezoidal configuration, there being T-shaped longitudinal grooves in said second surfaces, ending ahead of the narrow end of said pyramid;

guide elements of double-T configuration having a stem portion, a first and a second crossbar portion, the first crossbar portions of said guide elements being respectively slid into said grooves, the second crossbar portion having lateral rail portions, whereby the rail portions of adjacent guide elements facing each other across one of the first surfaces extend parallel to each other;

means for securing the guide elements in a slid position of their respective first crossbar portions in the grooves; and tube expanding segments slidably seated on said first surfaces and each having two lateral ridges respectively engaged with the rail portions of the guide elements disposed alongside the respective first surface and being guided therein.

2. An expander as in claim 1, wherein said grooves are blind ducts ending ahead of the narrow end of the pyramid, but being open at the wide end, said means including means extending transversely across said wide end.

* * * * *